United States Patent [19]

Zoor

[11] Patent Number: 4,498,685

[45] Date of Patent: Feb. 12, 1985

[54] SKI BINDING

[75] Inventor: Reinhold Zoor, Munich, Fed. Rep. of Germany

[73] Assignee: Heinrich Wunder GmbH & Co. KG, Dachau, Fed. Rep. of Germany

[21] Appl. No.: 331,928

[22] Filed: Dec. 17, 1981

[30] Foreign Application Priority Data

Dec. 19, 1980 [DE] Fed. Rep. of Germany ..... 3048175

[51] Int. Cl.[3] ..... A63C 7/10

[52] U.S. Cl. ..... 280/605; 280/615; 280/618

[58] Field of Search ..... 280/605, 615, 614, 618

[56] References Cited

U.S. PATENT DOCUMENTS

| | | | |
|---|---|---|---|
| 1,101,631 | 6/1914 | Jacques | 280/618 |
| 1,223,882 | 4/1917 | Jacques | 280/618 |
| 4,163,569 | 8/1979 | Horn | 280/618 |
| 4,210,342 | 7/1980 | Krob | 280/605 |
| 4,230,337 | 9/1980 | Storandt | 280/605 |
| 4,231,584 | 11/1980 | Kikuchi | 280/604 |
| 4,355,817 | 10/1982 | Krob | 280/605 |

FOREIGN PATENT DOCUMENTS

| | | | |
|---|---|---|---|
| 17179 | 8/1904 | Austria | 280/618 |
| 2838902 | 3/1980 | Fed. Rep. of Germany | 280/605 |
| 2412325 | 8/1979 | France | 280/605 |

*Primary Examiner*—David M. Mitchell
*Assistant Examiner*—Joseph G. McCarthy
*Attorney, Agent, or Firm*—Peter K. Kontler

[57] ABSTRACT

A ski has a safety binding which includes a support for a ski boot. The support carries retainers for the toe and heel of the boot and is pivotable about an axis extending transversely of the ski so that the ski boot may be swung away from the ski during skiing. A brake for the ski is mounted on the support and is arranged to be kept in an inoperative or non-braking position by the pressure of the ski boot. The brake is resiliently urged towards its operative or braking position and automatically moves to this position when the pressure of the ski boot is released. The ski is thus braked regardless of whether the boot is removed from the binding intentionally or unintentionally.

32 Claims, 8 Drawing Figures

SKI BINDING

BACKGROUND OF THE INVENTION

The invention relates generally to a ski binding.

More particularly, the invention relates to a safety binding which is associated with a braking mechanism for the ski.

A known ski binding has a support which is mounted on the ski for pivotal movement about an axis extending transverse to the longitudinal direction of the ski. The pivotal support carries retainers which receive the toe and heel of a ski boot and thereby secure the ski boot to the ski. The pivotal mounting of the support permits the ski boot to rest on the ski during a run and to be pivoted away from the ski when necessary.

Safety bindings of this type may be used for deep powder snow as well as hard packed snow. For powder snow, a strap is loosely connected with the ski to prevent the latter from escaping in the invent that the binding releases. However, the use of a strap has not been widely accepted for packed snow because the ski is liable to cause an accident in this case.

An alternative to a strap is a brake for the ski and it is already known to use such a brake in conjunction with a safety binding. A special device holds the brake in an inoperative position as long as the safety binding is not released. The brake becomes operative only when the safety binding is released unintentionally. If a skier disengages the boot from the ski, e.g. after a fall, so that the binding is not released unintentionally, the brake remains in its inoperative position. This is a considerable disadvantage since skiers often disengage the boot from the ski intentionally. Thus, the ski must here also be prevented from escaping so that it will not travel down the slope in an uncontrolled manner and cause an accident or be lost.

OBJECTS AND SUMMARY OF THE INVENTION

It is an object of the invention to provide a safety binding having a ski braking mechanism which becomes operative regardless of whether the ski becomes disengaged intentionally or unintentionally.

Another object of the invention is to provide a safety binding having a ski braking mechanism which becomes operative in automatic response to disengagement of the ski independently of whether or not such disengagement occurred intentionally or unintentionally.

An additional object of the invention is to provide a safety binding having a ski braking mechanism which may be maintained in an inoperative position without the special devices used heretofore.

A concomitant object of the invention is to provide a safety binding having a ski braking mechanism which may be maintained in an inoperative position by means of the pressure exerted by the foot of a skier.

It is also an object of the invention to provide a safety binding having a ski braking mechanism which does not interfere with skiing, especially cross-country-skiing.

The preceding objects, and others which will become apparent as the description proceeds, are achieved by the invention.

One aspect of the invention resides in a ski binding which comprises footwear, e.g. ski boot, retaining means and support means for the retaining means. The binding further comprises ski braking means mounted on the support means.

According to one embodiment of the invention, the support means is adapted to be mounted on a ski for pivotal movement about an axis extending transverse to the longitudinal axis of the ski and to normally bear against the ski during a skiing run.

The footwear retaining means may include retainers which are adapted to engage the sole of a ski boot at the toe and heel of the latter.

The arrangement of the braking means or brake on the support means or support, e.g. on a pivotal support plate or frame, permits the brake to be retained in its inoperative position by the footwear or ski boot which rests on the support. The brake may be resiliently biased so that it moves to its operative position and brakes the ski as soon as the ski boot is disengaged from the support. The ski is thus prevented from escaping regardless of whether the boot is disengaged by unintentional release of the binding or by intentional opening of the binding. Special devices for maintaining the brake in its inoperative position are no longer required.

In accordance with one embodiment of the invention, the brake is releaseably connected with the support in order to permit the use of a strap without a brake during extended runs in deep powder snow. The brake may be readily removed from the binding when a strap is to be used. This is desirable because the loose connection established between the boot and the ski by the strap may endanger the skier if the brake is present and moves to its operative position while the ski and the boot are connected by the strap.

According to an advantageous embodiment of the invention, the support is in the form of a frame. The brake is mounted on a carrier having outer portions which are provided with receiving means for the frame and serve to hold the brake on the frame. An arresting device is supported by the carrier and functions to fix the latter in a predetermined position as considered in the longitudinal direction of the frame.

The preceding embodiment of the invention permits the brake to be mounted on the support in such a manner that neither the safety release function of the binding nor the ability of the binding to adjust to changes in length as the ski flexes are affected by the brake. Thus, by arranging the brake on a carrier, it becomes possible to prevent forces capable of deforming the support from being transmitted to the same. The reason is that the restoring force which tends to return the brake to its operative position may be absorbed by the carrier. This may be achieved regardless of whether the restoring force is generated entirely by elastic deformation of the brake or whether the brake is urged to its operative position by means of biasing elements such as springs.

As mentioned earlier, the support may be in the form of a frame. The frame may include a pair of legs which are adapted to extend in parallelism with the longitudinal edges of a ski while the carrier for the brake may comprise two carrier blocks or elements which are connected by a web and have sides which are likewise adapted to be parallel to the longitudinal edges of the ski. These sides of the carrier blocks may be provided with grooves for the legs of the frame. An arresting device may be provided for fixing the carrier in a predetermined position as considered in the longitudinal direction of the ski. The arresting device may be in the form of a spacer which is pivotally supported by the carrier. The arresting device may have a free end which is adapted to be received in a recess provided in one of the retainers for the ski boot, that is, the retainer for the toe of the boot or that for the heel of the boot. This arrangement makes it possible to rapidly secure the brake to the binding. Thus, the brake may be mounted on the binding simply by spreading the legs of the frame and inserting the carrier between the legs. The carrier may then be maintained in the proper position along the longitudinal direction of the ski by the arresting device. In addition to its arresting function, the latter may also serve to transmit the braking forces to a retainer for the ski boot.

Another embodiment of the invention makes it possible to secure the brake to the binding even more rapidly. Here, the two grooves which receive the legs of the frame have curved extensions which pass around diagonally opposite corners of the carrier and extend towards the center of the latter. The spacing between the grooves, as well as the spacing between the extensions thereof, corresponds essentially to the distance between the legs of the frame. With this arrangement, the carrier may be inserted between the legs of the frame in a position which is rotated relative to the position which the carrier assumes during use so that the legs engage the curved extensions of the grooves. The carrier may then be rotated into the latter position. The carrier can be rapidly disengaged from the binding in the same manner.

In accordance with an additional embodiment of the invention, the grooves are linear and a transition region exists between each groove and its extension. The spacing between the transition regions is somewhat larger than the distance between the legs of the frame. This causes the legs of the frame to be spread apart while the carrier is rotated to its position of use. A snap action is obtained in this manner and has the effect that the carrier cannot be moved from its position of use without the exertion of a certain amount of force. This results in a locking action which is additional to that generated by the arresting device. The legs of the frame are not stressed by the carrier when the latter is in its position of use since the spacing between the grooves substantially corresponds to the distance between the legs. The carrier, and accordingly the entire braking mechanism, is supported by one of the retainers for the ski boot via the arresting device. Thus, neither the safety release function of the binding nor the ability of the binding to adjust to changes in length due to flexing of the ski is affected by the braking mechanism.

Still another embodiment of the invention contemplates for the brake to have horizontal bearing portions and for the arresting device to be in the form of a wire having a U-shaped configuration. In this case, the closed end of the arresting device is adapted to engage a recess in one of the retainers for the ski boot while the free ends of the legs of the arresting device are articulated to the horizontal bearing portions of the brake. The legs of the arresting device may then be located adjacent to the inner surfaces of the legs of the frame thereby protecting the legs of the frame from interfering surfaces which may enter the gap between the legs of the frame. The pivotal mounting of the arresting device provides the further advantage that the arresting device may be brought into parallelism with the brake when the braking mechanism is removed from the binding. This allows the braking mechanism to be compact so that it may be readily placed in the pocket of a parka when a skier decides to use a strap.

According to a further embodiment of the invention, the carrier may include a pair of carrier blocks connected by a sheet-like member which is situated below the frame when the braking mechanism is in use. The sheet-like member has raised marginal portions which are bent inwardly and partly surround the legs of the frame. The sheet-like member may function as an arresting device or spacer and advantageously has a tongue which is adapted to be received in a recess provided in one of the retainers for the ski boot.

The carrier blocks may be composed of a synthetic resin or plastic which can function as a bearing material while the web or the sheet-like member connecting the carrier blocks may be composed of relatively thick or strong sheet material. This makes it possible for the forces which are generated due to deformation of the resilient or elastically deformable brake to be entirely absorbed by the carrier so that the binding is not stressed by these forces.

As indicated previously, the restoring force for urging the brake into its operative position may be generated by elastically deforming the brake. The requisite elastic deformation of the brake may be achieved by means of guide surfaces for the brake. In accordance with a favorable embodiment of the invention, the brake is guided between a pair of carrier blocks and the guide surfaces are provided on the sides of the carrier blocks which face one another. This enables the guide surfaces to be readily formed on the carrier blocks during manufacture of the latter, e.g. the guide surfaces may be integrally cast with the carrier blocks.

As mentioned earlier, the carrier blocks may be connected by a web. The web may be constituted by a pair of spaced sheet-like elements which are so inclined relative to one another as to define a roof-like or wedge-like surface which faces downwards. The snow which accumulates on the ski in the region below the carrier is broken up and spread apart by the roof-like or wedge-like surface thereby preventing the formation of large snow deposits below the carrier during skiing. Any effect of the braking mechanism on skiing is thus largely avoided.

The effect of the braking mechanism on skiing may be further reduced by arranging the braking mechanism between the legs of the frame and by making the height of the braking mechanism in its inoperative position small. Advantageously, the height of the braking mechanism in its inoperative position is no greater than the height of the retainers which the frame carries for the ski boot.

In order to make the height of the braking mechanism in its inoperative position small, the brake may be designed with an ⅝-shaped section having a pair of horizontal bearing portions or legs which are joined by an elastically deformable portion or loop. The carrier here includes a pair of carrier blocks and each of the latter is provided with a downwardly open groove which receives one of the bearing portions of the brake. The elastically deformable portion or loop, which widens in a direction away from the bearing portions, extends to a location above the carrier blocks and is accommodated between and compressed by the same.

When the braking mechanism according to the embodiment of the invention just described is in use, the bearing portions are located below the legs of the frame which carries the retainers for the ski boot. This assists in keeping the overall height of the braking mechanism small. It is possible to position the bearing portions below the legs of the frame since the leading or front end of the frame is mounted on a support while the trailing or rear end of the frame rests on an arresting mechanism thereby leaving a small gap between the ski and the frame when the latter is in position on the ski. The gap is sufficiently large for the bearing portions of the brake. Furthermore, since the brake is held in compression between the carrier blocks so that it cannot drop down, the grooves which receive the bearing portions may not only be downwardly open as mentioned above but need only be deep enough for the bearing portions to fit therein. This permits a height reduction to be achieved and, in addition, makes it possible to greatly simplify removal of the brake from the carrier blocks. Thus, the brake may be elastically compressed to such a degree that it can be rotated relative to the carrier blocks and thereby disengaged from the latter. If the member which connects the carrier blocks is provided with a sufficiently large opening, the brake may then be withdrawn from the braking mechanism via the opening in a downward direction. The brake may be inserted into the braking mechanism in the reverse manner. This procedure may not be possible in the embodiment of the invention where the carrier blocks are connected by a web which includes a pair of spaced sheet-like elements. Nevertheless, since such sheet-like elements may be secured to the carrier blocks in a simple manner by screw connectors, the brake may be easily removed from and inserted into the brake mechanism in this embodiment of the invention also.

The novel features which are considered as characteristic of the invention are set forth in particular in the appended claims. The improved ski binding itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
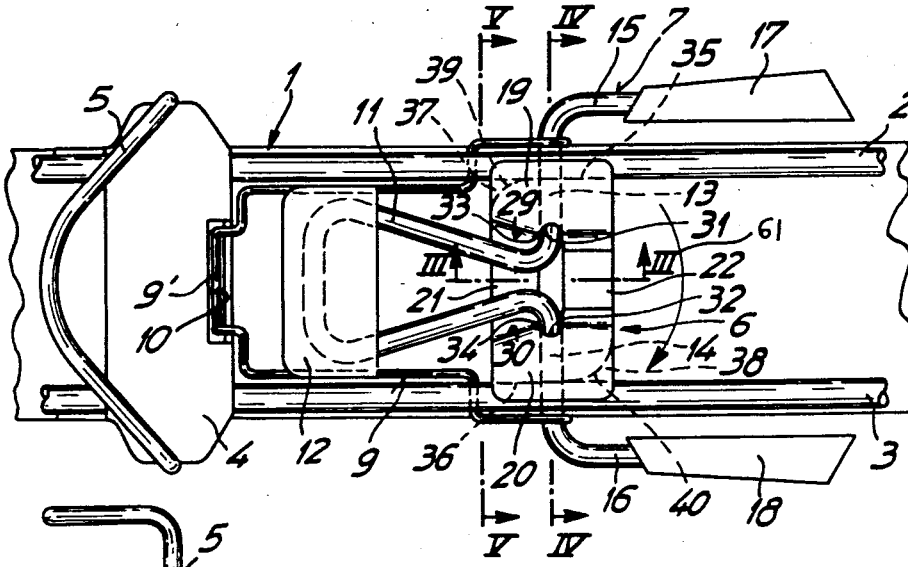
FIG. 1 is a plan view of a ski binding having a braking mechanism in accordance with the invention.
Figure 2:
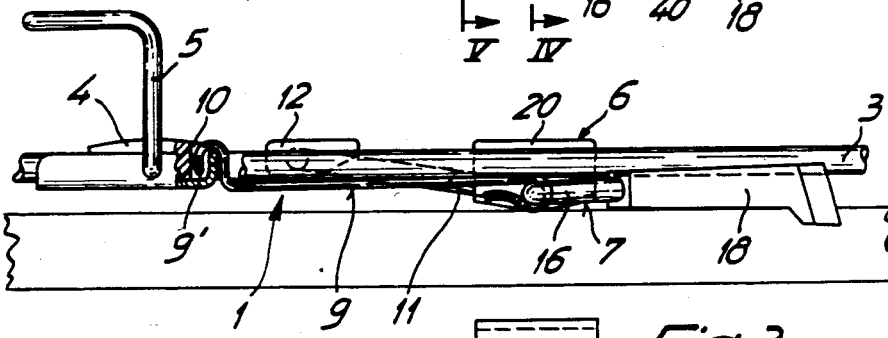
FIG. 2 is a side view of the binding of FIG. 1.

FIGS. 1, 2, 4 and 5 illustrate a safety binding mounted on a ski 60. In order to facilitate an understanding of the invention, all that is shown of the safety binding is a portion of a frame or support 1 having a pair of legs 2 and 3. The legs 2 and 3 are in the form of wires having round cross sections. The legs 2 and 3 carry a pair of retainers which receive the sole of a ski boot to thereby connect the ski boot with the ski 60. One of the retainers is located towards the rear of the binding and engages the ski boot at the heel while the other retainer is located towards the front of the binding and engages the ski boot at the toe. Only the front retainer is illustrated here. The rear retainer and the safety release mechanism of the binding are not shown since this is not necessary for an understanding of the invention. The front retainer includes a plate or crosspiece 4 which supports a bracket 5. The sole of the boot rests on the plate 4 and extends beneath the bracket 5 so that it is confined by the plate 4 and the bracket 5.

The frame 1 is mounted on a non-illustrated support for pivotal movement about an axis extending transverse to the longitudinal axis of the ski 60. The pivot axis is located towards the front of the binding. The frame 1 may be swung away from the ski 60 about the pivot axis during skiing so that the boot may be lifted from the ski 60.

Figure 6:
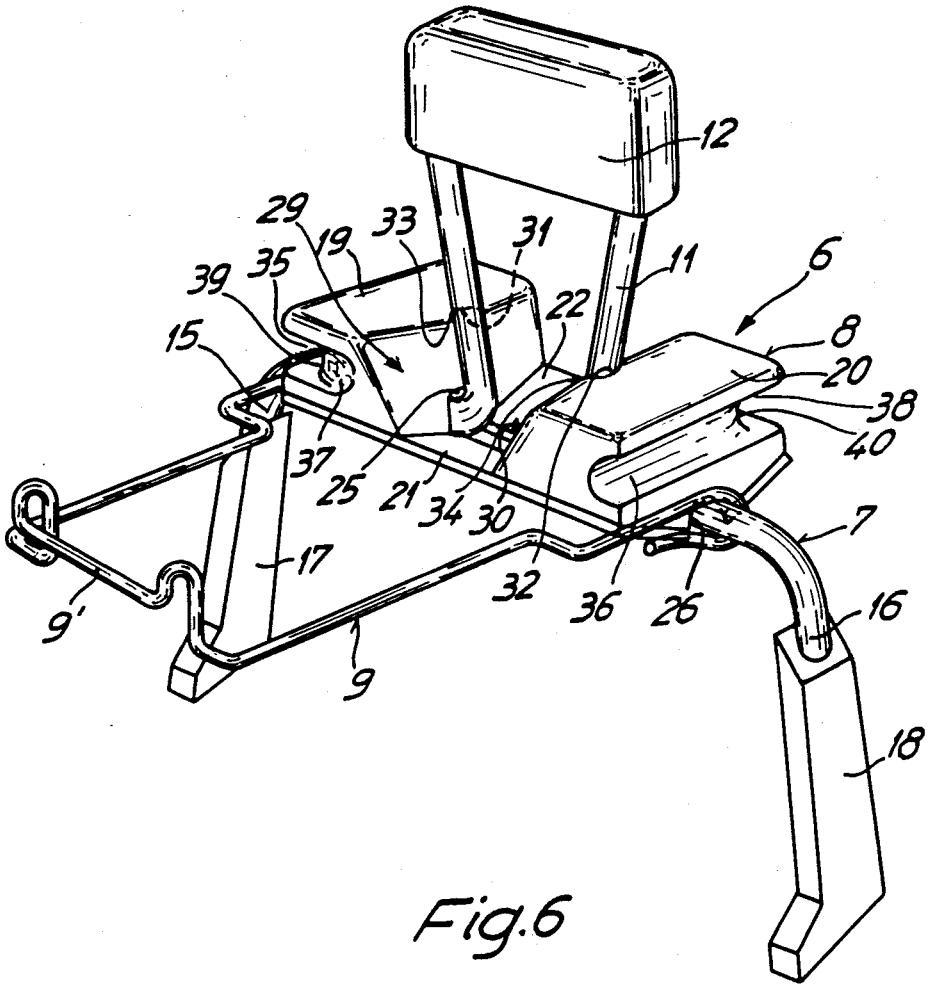
FIG. 6 is a perspective view of the braking mechanism of FIG. 1.
Figure 6A:
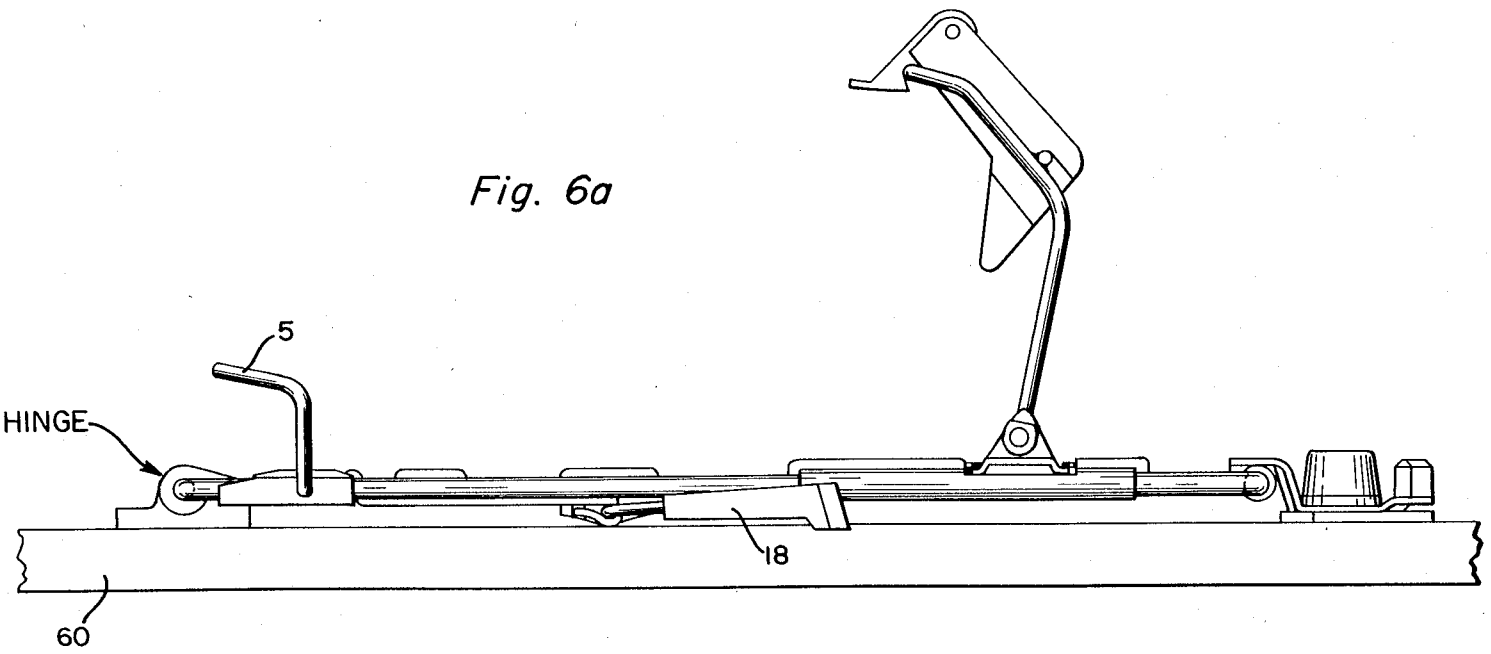
FIG. 6*a* is a fragmentary side elevational view of a cross-country ski and of the ski binding shown in FIGS. 1 to 6.

A braking mechanism identified generally by the reference numeral 6 is arranged between the legs 2 and 3 of the frame 1 in the region of the front retainer 4, 5. With regard now to FIG. 6 also, the braking mechanism 6 comprises a resilient or elastically deformable brake 7. The brake 7 is pivotally mounted in a carrier 8 and is maintained in a predetermined position along the longitudinal direction of the frame 1 by means of a spacer or arresting device 9 which, in turn, is pivotally mounted on the brake 7.

The brake 7 is made from a single piece of resilient wire and has an upper, Ω-shaped section which includes an elastically deformable portion or loop 11 and a pair of horizontal bearing portions 13 and 14. The loop 11 carries a plate 12 which is adapted to be engaged by the sole of a boot. The brake 7 further has a lower section which comprises a pair of braking arms 15 and 16 respectively extending from the bearing portions 13 and 14. Brake shoes 17 and 18 are mounted on the ends of the respective braking arms 15 and 16. The brake shoes 17 and 18 are composed of a synthetic resin.

The spacer 9 is generally U-shaped. The closed end of the spacer 9 is bent so as to define a latch 9'. The latch 9' is received in a recess 10 provided in the plate 4 of the front retainer for the ski boot to thereby fix the braking mechanism 6 at a very precise location along the longitudinal axis of the frame 1 and the ski 60. The free ends of the spacer 9 remote from the latch 9' are articulated to the bearing portions 13 and 14 of the brake 7 so that the spacer 9 is pivotally supported by the brake 7.

The carrier 8 for the brake 7 includes a pair of carrier blocks or portions 19 and 20 which are composed of a self-lubricating synthetic resin. The carrier blocks 19 and 20 are connected by a web which comprises a pair of spaced strips or sheet-like elements 21 and 22.

Figure 3:
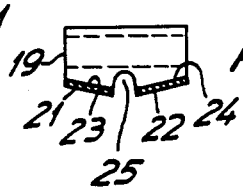
FIG. 3 is a sectional view in the direction of the arrows III—III of FIG. 1.
Figure 4:
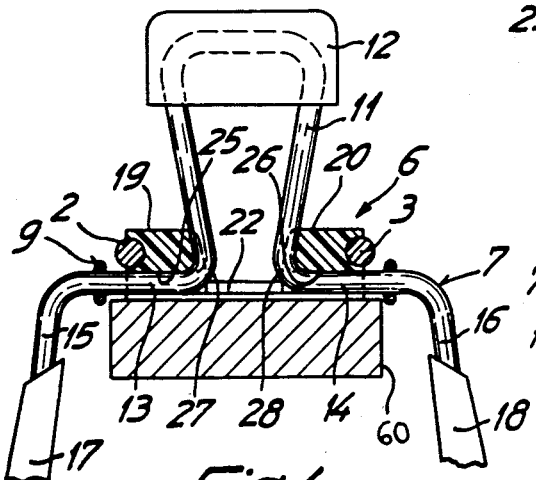
FIG. 4 is a sectional view in the direction of the arrows IV—IV of FIG. 1.
Figure 5:
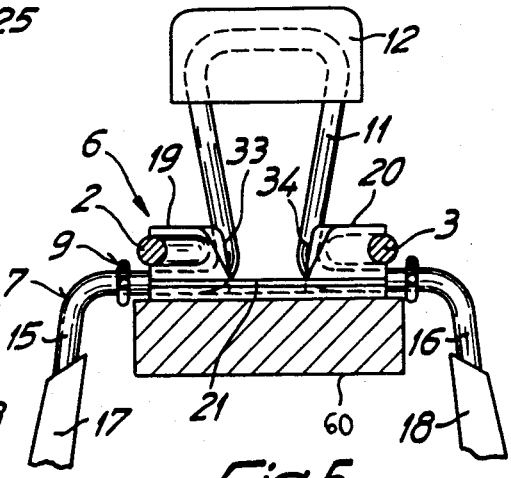
FIG. 5 is a sectional view in the direction of the arrows V—V of FIG. 1.

Each of the carrier blocks 19 and 20 has a pair of lower surfaces 23 and 24 and the strips 21 and 22 are connected to such lower surfaces 23 and 24, e.g. by threaded connectors. As most clearly seen in FIG. 3, the lower surfaces 23 and 24 of each of the carrier blocks 19 and 20 are arranged in a roof-like or wedge-like manner, that is, are inclined relative to one another about an axis extending transverse to the longitudinal axis of the frame 1 and the ski 60. Since the strips 21 and 22 are connected with the lower surfaces 23 and 24, the strips 21 and 22 are similarly inclined relative to one another. The thickness of each of the carrier blocks 19 and 20 increases in a direction from the front and the back towards the center thereof and the thickness of each of the carrier blocks 19 and 20 is greatest near its central portion. The strips 21 and 22 are arranged in such a manner that the neighboring edges thereof are located in the regions of the thickest portions of the carrier blocks 19 and 20. This causes a wedge effect to be exerted on the snow which accumulates on the ski 60 in the region below the carrier 8. Since snow is thus prevented from accumulating below the carrier 8 to any significant extent, ice formation below the braking mechanism 6 due to packed snow on the ski 60 is avoided.

The brake 7 is pivotally mounted on the carrier 8 via the bearing portions 13 and 14 thereof. This is achieved in that the carrier blocks 19 and 20 are provided with respective grooves 25 and 26 in the lower surfaces 23, 24 thereof. Each of the grooves 25 and 26 is located in the middle of the respective carrier block 19 or 20. The grooves 25 and 26 are downwardly open and are deep enough to entirely accommodate the bearing portions 13 and 14 of the brake 7.

The carrier blocks 19 and 20 are provided with respective guide surfaces 29 and 30. The loop 11, as well as the curved transition regions 27 and 28 between the loop 11 and the respective bearing portions 13 and 14, are compressed between the guide surfaces 29 and 30 by virtue of the fact that the loop 11 widens in a direction away from the bearing portions 13 and 14. Grooves 31 and 32 are provided at the centers of the respective guide surfaces 29 and 30 and serve to hold the brake 7 in the operative or braking position shown in FIGS. 4–6. Inwardly extending projections 33 and 34 are provided at the front edges of the respective grooves 31 and 32. The brake 7 must be forced by the projections 33 and 34 in order to pivot the same from the operative position of FIGS. 4–6 to the inoperative position shown in FIGS. 1 and 2. Pivoting of the brake 7 from the operative to the inoperative position may be achieved by pressing the brake 7 forward with a boot when the ski 60 is put on. The projections 33 and 34 cause the loop 11 to be further compressed as the brake 7 is swung from the operative to the inoperative position. The additional compression generates a restoring force which urges the brake 7 towards its operative position. When the boot is removed from the frame 1 so that the force holding the brake 7 in its inoperative position no longer exists, the restoring force returns the brake 7 to its operative position in which the loop 11 is received in the grooves 31 and 32. As best seen in FIG. 1, the Ω-shaped section of the brake 7 is located between the legs 2 and 3 of the frame 1 in the inoperative position while the braking arms 15 and 16 are located outside of the frame 1 and are parallel to the legs 2 and 3.

In order to hold the braking mechanism 6 on the frame 1, the sides of the carrier blocks 19 and 20 which are parallel to the longitudinal edges of the ski 60 and to the legs 2 and 3 are provided with respective grooves 35 and 36. The grooves 35 and 36 are adapted to receive the legs 2 and 3 of the frame 1 and the shapes of the grooves 35 and 36 conform to the shapes of the legs 2 and 3. The spacing between the grooves 35 and 36 corresponds essentially to the spacing between the legs 2 and 3 so that substantially no stress exists in the legs 2 and 3 when these are received in the grooves 35 and 36. The grooves 35 and 36 are straight. The groove 35 has a curved extension 37 which extends inwardly of the carrier 8 around one of the corners of the carrier block 19. Similarly, the groove 36 has a curved extension 38 which extends inwardly of the carrier 8 around one of the corners of the carrier block 20. The corner of the carrier block 19 having the extension 37 and the corner of the carrier block 20 having the extension 38 are located at diagonally opposite locations of the carrier 8. The spacing between the extensions 37 and 38 is again substantially equal to the spacing between the legs 2 and 3 of the frame 1. The groove 35 and its extension 37 are connected by a transition region 39 while the groove 36 and its extension 38 are connected by a transition region 40. The transition regions 39 and 40 cooperate to provide a locking function and the distance between the transition regions 39 and 40 is somewhat larger than the spacing between the legs 2 and 3 of the frame 1.

To mount the braking mechanism 6 on the frame 1, the carrier 8 is rotated in a horizontal plane relative to the position shown in FIG. 1 and placed between the legs 2 and 3 in such a manner that the latter are received in the curved extensions 37 and 38 of the grooves 35 and 36. The carrier 8 is then rotated towards the position of use illustrated in FIG. 1. During this rotation, the legs 2 and 3 are elastically spread somewhat further apart by the transition regions 39 and 40 connecting the grooves 35 and 36 and their respective extensions 37 with 38. Once the transition regions 39 and 40 have passed by the legs 2 and 3, the legs 2 and 3 enter the grooves 35 and 36 and elastically return to their original positions. The legs 2 and 3 remain in the grooves 35 and 36 while the braking mechanism 6 is mounted on the binding.

Once the carrier 8 has been rotated to its position of use, the carrier 8 is fixed in position along the longitudinal direction of the frame 1 and the ski 60 by means of the pivotable spacer 9. Thus, the latch 9' of the spacer 9 is inserted in the recess 10 of the plate 4 after the carrier 8 has been rotated to its position of use. The spacer 9, which is made of wire in the present embodiment, is U-shaped as mentioned earlier. The spacer 9 is so constructed and arranged that its legs lie adjacent the inner surfaces of the legs 2 and 3 of the frame 1 during use.

In use, the carrier 8 is supported by the frame 1 in such a manner that the horizontal bearing portions 13 and 14 of brake 7 are located below the legs 2 and 3 of the frame 1. Although the grooves 25 and 26 which receive the bearing portions 13 and 14 are downwardly open, the brake 7 cannot drop out of the carrier 8 since the loop 11 of the brake 7 widens in a direction away from the bearing portions 13 and 14 and, in addition, is held in compression by the carrier blocks 19 and 20.

The arrow 61 in FIG. 1 indicates the direction in which the carrier 8 must be rotated in order to disengage the same from the legs 2 and 3 of the frame 1.

Figure 7:
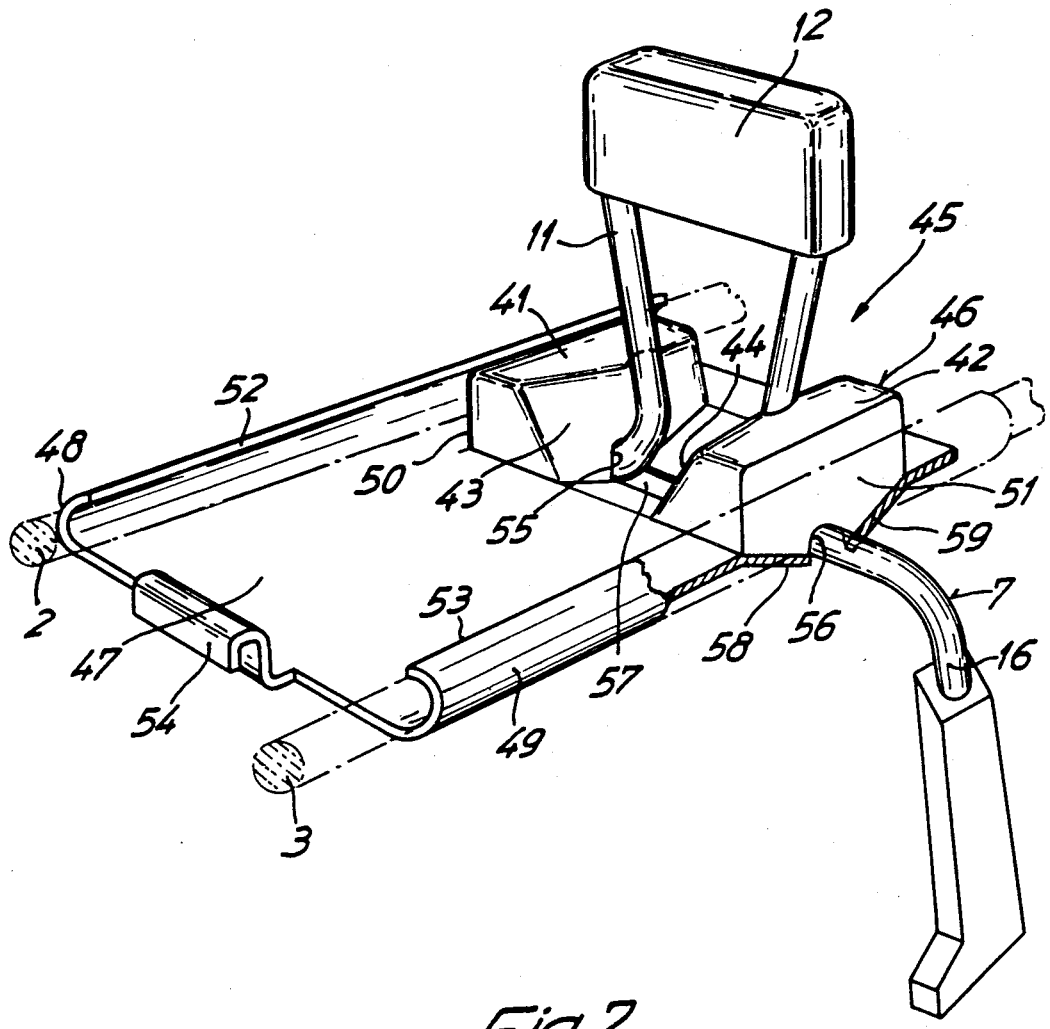
FIG. 7 is a perspective view of another embodiment of the braking mechanism according to the invention.

In FIG. 7, another embodiment of a braking mechanism is identified generally by the reference numeral 45. The braking mechanism 45 includes a carrier 46 which comprises a pair of carrier blocks or portions 41 and 42. As before, the brake 7 is pivotally mounted on the carrier blocks 41 and 42. The carrier blocks 41 and 42 have guide surfaces 43 and 44 which face one another and, similarly to the guide surfaces 29 and 30 of the previous embodiment, hold the loop 11 of the brake 7 in compression. The guide surfaces 43 and 44 also function to additionally compress the loop 11 when the brake 7 is swung from its operative position to its inoperative position.

The carrier 46 further includes a sheet-like member or pan-shaped holder 47 which supports the carrier blocks 41 and 42 and connects these with one another. The holder 47 is elastically deformable. The longitudinal marginal portions or edges 48 and 49 of the holder 47 are raised and bent inwardly to define receiving spaces for the legs 2 and 3 of the frame 1. The receiving spaces are not fully enclosed but are open at the respective sides thereof facing the carrier blocks 41 and 42 so that the legs 2 and 3 are only partially surrounded by the edges 48 and 49. The carrier blocks 41 and 42 abut the inner surfaces of the legs 2 and 3 when the braking mechanism 45 is mounted on the frame 1.

The edge faces 52 and 53 of the edges 48 and 49 are spaced from the outer surfaces 50 and 51 of the respective carrier blocks 41 and 42 by distances which are less than the diameters of the legs 2 and 3. In order to mount the braking mechanism 45 on the frame 1, the edges 48 and 49 of the holder 47 are elastically bent outwards until the gaps between the edge faces 52 and 53 and the respective outer surfaces 50 and 51 of the carrier blocks 41 and 42 exceed the diameters of the legs 2 and 3. The legs 2 and 3 are inserted into the receiving spaces defined by the edges 48 and 49 and the latter are then released. The legs 2 and 3 are then confined between the edges 48 and 49 and the respective carrier blocks 41 and 42. This secures the braking mechanism 45 to the frame 1.

In order to arrest the braking mechanism 45, that is, to fix the braking mechanism 45 at a predetermined location along the longitudinal direction of the frame 1 and the ski 60, the holder 47 is provided with a tongue 54 which is adapted to be received in the recess 10 of the plate 4. The holder 47 thus fulfills the functions of the spacer 9 as well as the strips 21 and 22 of the embodiment of FIGS. 1–6.

It is not necessary for the holder 47 to be elastically deformable to such a degree that the edges 48 and 49 may be elastically bent outwards to an extent sufficient to permit passage of the legs 2 and 3 between the edge faces 52 and 53 and the respective outer surfaces 50 and 51 of the carrier blocks 41 and 42. If the holder 47 does not possess the required elasticity, the carrier blocks 41 and 42 may be mounted on the holder 47 for sliding movement towards and away from the edges 48 and 49. This will permit the braking mechanism 45 to be mounted on the frame 1 without bending the edges 48 and 49.

As is the case in the previous embodiment, the lower surfaces of the carrier blocks 41 and 42 are provided with downwardly open grooves 55 and 56 for the horizontal bearing portions 13 and 14 of the brake 7. The grooves 55 and 56 are again sufficiently deep to accommodate the bearing portions 13 and 14 entirely. The holder 47 is provided with an opening 57 between the grooves 55 and 56. The opening 57 is necessary inasmuch as it is desired for the bearing portions 13 and 14 of the brake 7 to be located below the legs 2 and 3 of the frame 1 when the braking mechanism 45 is in use. Since the loop 11 of the brake 7 again widens in a direction away from the bearing portions 13 and 14 and, in addition, is again held in compression by the carrier blocks 41 and 42, the brake 7 cannot drop down in spite of the presence of the opening 57.

The opening 57 is bounded by a pair of strip-shaped portions 58 and 59 of the holder 47. The strip-shaped portions 58 and 59 are bent downwards and are inclined relative to one another in a roof-like or wedge-like manner similarly to the strips 21 and 22 of the previous embodiment. The lower surfaces of the carrier blocks 41 and 42 have a corresponding configuration, that is, the lower surface of each of the carrier blocks 41 and 42 includes a pair of surface portions which are inclined relative to one another in a roof-like or wedge-like manner in the same way as the lower surfaces 23 and 24 of the carrier blocks 19 and 20 in the preceding embodiment. The arrangement of the strip-shaped portions 58 and 59 and the corresponding lower surfaces of the carrier blocks 41 and 42 is the same as in FIG. 3.

It will be understood that various modifications can be made within the scope of the invention. For example, the plate 12 which is carried by the loop 11 of the brake 7 may be pivotally mounted on the loop 11 in order to facilitate pivoting of the brake 7 from the operative position to the inoperative position by means of a ski boot. Furthermore, the recess 10 which receives the latch 9′ or the tongue 54 may be provided in the rear retainer for the ski boot rather than the front retainer 4, 5.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A ski, comprising a slat; retaining means for an article of footwear, said retaining means having a recess; support means carrying said retaining means and designed to support an article of footwear, said support means being mounted on said slat for pivotal movement between a first position in which both the toe and heel of a skier are adjacent to said slat and a second position in which the heel is lifted away from said slat; ski braking means including a brake movable between an inoperative position and an operative position in which forward and backward movement of said slat are inhibited, said braking means being mounted on said support means for movement therewith and said braking means further comprising a carrier for said brake, said carrier having means for urging said brake to said operative position in all positions of said support means when said support means is free of an article of footwear, said brake being held in the inoperative position by an article of footwear on said support means; and arresting means for fixing said braking means in a predetermined position on said support means, as considered in the longitudinal direction of said slat, said arresting means comprising a spacer having an arresting end and being mounted on said carrier for movement between a free position and an arresting positioned in which said recess receives said arresting end to thereby fix said braking means in said predetermined position.

2. A ski as defined in claim 1, wherein said recess is located at the rear of said retaining means as considered in the direction of movement of said slat.

3. A ski as defined in claim 1, wherein said recess is located at the front of said retaining means as considered in the direction of movement of said slat.

4. A ski as defined in claim 1, wherein said spacer is connected with said brake.

5. A ski binding comprising: p1 (a) footwear retaining means;

(b) support means for said retaining means having a pair of legs; and (c) ski braking means mounted on said support means, said braking means including a carrier, and a brake mounted on said carrier, and said carrier being provided with a pair of grooves which receive said legs.

6. A binding as defined in claim 5, wherein said carrier has a pair of outer surfaces which are adapted to extend in substantial parallelism with the longitudinal edges of a ski and said grooves are located in said outer surfaces.

7. A binding as defined in claim 5, wherein the spacing between said grooves substantially corresponds to the spacing between said legs.

8. A binding as defined in claim 5, said carrier having a pair of diagonally opposed corners; and wherein each of said grooves has a main portion extending to the region of one of said corners, and an extension around the respective corner.

9. A binding as defined in claim 8, wherein said extensions are arcuate.

10. A binding as defined in claim 8, wherein the spacing between said main portions and the spacing between said extensions substantially correspond to the spacing between said legs.

11. A binding as defined in claim 8, wherein said main portions are straight.

12. A binding as defined in claim 8, wherein each of said grooves has a transition region between the respective main portion and extension and the spacing between said transition regions exceeds the spacing between said legs.

13. A binding as defined in claim 5, wherein said grooves are straight.

14. A ski binding comprising:

(a) footwear retaining means;

(b) support means for said retaining means; and (c) ski braking means mounted on said support means, said braking means including a carrier, and a brake mounted on said carrier, and said carrier comprising a pair of carrier elements, and a sheet-like member which supports said carrier elements, said sheet-like member having a pair of raised marginal portions which are bent inwardly to define receiving spaces for said support means.

15. A binding as defined in claim 14, said receiving spaces each having an open side facing a respective carrier element; and wherein said support means comprises a pair of legs which are accommodated in said receiving spaces and confined between said marginal portions and said carrier elements.

16. A binding as defined in claim 14, wherein said sheet-like member is located below said support means.

17. A binding as defined in claim 14, said retaining means having a recess; and wherein said sheet-like member comprises a tongue adapted to be received by said recess so as to fix said braking means in a predetermined position on said support means as considered in the longitudinal direction of a ski.

18. A ski binding comprising:

(a) footwear retaining means having a recess;

(b) support means for said retaining means;

(c) ski braking means mounted on said support means, said braking means including a carrier, and a brake mounted on said carrier and having a pair of bearing portions; and (d) arresting means on said carrier for fixing said braking means in a predetermined position on said support means as considered in the longitudinal direction of a ski, said arresting means comprising a spacer connected with said brake and having an arresting end, and said spacer being mounted on said carrier for movement between a free position and an arresting position in which said recess receives said arresting end to thereby fix said braking means in said predetermined position, said spacer being substantially U-shaped and including a pair of legs having free ends remote from said arresting end, and each of said free ends being articulated to one of said bearing portions.

19. A binding as defined in claim 18, wherein said bearing portions are substantially horizontal.

20. A binding as defined in claim 18, wherein said spacer is composed of wire.

21. A binding as defined in claim 18, whereinsaid arresting end is bent to define a latch which is received by said recess in said arresting position.

22. A ski, comprising a slat; retaining means for an article of footwear; support means carrying said retaining means and designed to support an article of footwear, said support means being mounted on said slat for pivotal movement between a first position in which both the toe and heel of a skier are adjacent to said slat and a second position in which the heel is lifted away from said slat; and ski braking means including a brake movable between an inoperative position and an operative position in which forward and backward movement of said slat are inhibited, said brake including an Ω-shaped section having a pair of bearing portions joined by an elastically deformable portion, said braking means being mounted on said support means for movement therewith and said braking means further comprising a carrier for said brake, said carrier having means for urging said brake to said operative position in all positions of said support means when said support means is free of an article of footwear, said carrier means comprising a pair of carrier elements provided with downwardly open grooves which receive said bearing portions, said elastically deformable portion being compressed between said carrier elements to thereby hold said brake on said carrier, said brake being held in the inoperative position by an article of footwear on said support means.

23. A ski as defined in claim 22, wherein said bearing portions are substantially horizontal.

24. A ski as defined in claim 22, wherein said elastically deformable portion extends upwardly from said bearing portions to a level above said carrier elements and widens in a direction away from said bearing portions.

25. A ski binding comprising:

(a) footwear retaining means having a recess;

(b) support means for said retaining means;

(c) ski braking means mounted on said support means, said braking means including a carrier, and a brake mounted on said carrier; and (d) arresting means on said carrier for fixing said braking means in a predetermined position on said support means as considered in the longitudinal direction of a ski, said arresting means comprising a spacer having an arresting end, and said spacer being pivotally mounted on said carrier for movement between a free position and an arresting position in which said recess receives said arresting end to thereby fix said braking means in said predetermined position.

26. A ski binding comprising:

(a) footwear retaining means;

(b) support means for said retaining means; and (c) ski braking means mounted on said support means, said braking means including a carrier, and a brake mounted on said carrier, and said carrier comprising a pair of carrier elements, and a web connecting said carrier elements, said web including a pair of spaced sheet-like elements which are inclined about an axis extending transverse to the longitudinal direction of said support means so as to define a wedge-like surface, and each of said carrier elements being provided with a pair of lower surface portions having inclinations corresponding to the inclinations of said sheet-like elements and supported by the latter.

27. A ski binding comprising:

(a) footwear retaining means;

(b) support means for said retaining means; and (c) ski braking means mounted on said support means, said braking means including a carrier, and a brake mounted on said carrier, and said carrier comprising a pair of carrier elements, and a web connecting said carrier elements, the thicknesses of the front and back of each of said carrier elements as considered in the longitudinal direction of a ski being less than the thickness of a central portion thereof.

28. A ski binding comprising:

(a) footwear retaining means;

(b) support means for said retaining means having a pair of legs; and (c) ski braking means mounted on said support means, said braking means including a carrier, and a brake mounted on said carrier, and said brake comprising an Ω-shaped section between said legs.

29. A ski binding comprising:

(a) footwear retaining means;

(b) support means for said retaining means having a pair of legs; and (c) ski braking means mounted on said support means, said braking means including a carrier, and a brake, mounted on said carrier and comprising an Ω-shaped section having a pair of bearing portions located below said legs and joined by an elastically deformable portion, and said carrier including a pair of carrier elements provided with downwardly open grooves which receive said bearing portions, said elastically deformable portion being compressed between said carrier elements to thereby hold said brake on said carrier.

30. A ski, comprising a slat; retaining means for an article of footwear; support means carrying said retaining means and designed to support an article of footwear, said support means being mounted on said slat for pivotal movement between a first position in which both the toe and heel of a skier are adjacent to said slat and a second position in which the heel is lifted away from said slat; and ski braking means including a brake movable between an inoperative position and an operative position in which forward and backward movement of said slat are inhibited, said braking means being mounted on said support means for movement therewith and said braking means further comprising a carrier for said brake, said carrier having means for urging said brake to said operative position in all positions of said support means when said support means is free of an article of footwear, said brake being held in the inoperative position by an article of footwear on said support means and said carrier having outer portions provided with receiving means for said support means to thereby hold said braking means in engagement with said support means.

31. A ski, comprising a slat; retaining means for an article of footwear; support means carrying said retaining means and designed to support an article of footwear; said support means being mounted on said slat for pivotal movement between a first position in which both the toe and heel of a skier are adjacent to said slat and a second position in which the heel is lifted away from said slat; and ski braking means including a brake movable between an inoperative position and an operative position in which forward and backward movement of said slat are inhibited, said braking means being mounted on said support means for movement therewith and said braking means further comprising a carrier for said brake, said carrier having means for urging said brake to said operative position in all positions of said support means when said support means is free of an article of footwear and said carrier including a pair of carrier elements and a web connecting said carrier elements, said brake being held in said inoperative position by an article of footwear on said support means.

32. A ski, comprising a slat; retaining means for an article of footwear; support means carrying said retaining means and designed to support an article of footwear, said support means being mounted on said slat for pivotal movement between a first position in which both the toe and heel of a skier are adjacent to said slat and a second position in which the heel is lifted away from said slat; and ski braking means including an elastically deformable brake movable between an inoperative position and an operative position in which forward and backward movement of said slat are inhibited, said braking means being mounted on said support means for movement therewith and said braking means further comprising a carrier for said brake, said carrier having means for urging said brake to said operative position in all positions of said support means when said support means is free of an article of footwear and said carrier comprising a pair of carrier elements having facing surfaces for guiding and elastically deforming said brake, said brake being held in the inoperative position by an article of footwear on said support means.

* * * * *